US005825277A

United States Patent [19]

Bishop et al.

[11] Patent Number: 5,825,277

[45] Date of Patent: Oct. 20, 1998

[54] THERMAL PELLET CUTOFF SWITCH

[75] Inventors: Ralph L. Bishop, Mansfield; James B. Kalapodis, Akron, both of Ohio

[73] Assignee: Therm-O-Disc, Incorporated, Mansfield, Ohio

[21] Appl. No.: 722,612

[22] Filed: Sep. 27, 1996

[51] Int. Cl.[6] ..... H01H 37/76

[52] U.S. Cl. ..... 337/407; 337/414

[58] Field of Search ..... 337/401–409

[56] References Cited

U.S. PATENT DOCUMENTS

| | | | |
|---|---|---|---|
| 4,208,647 | 6/1980 | McVey et al. | 337/404 |
| 4,255,736 | 3/1981 | Kelley et al. | 337/407 |
| 4,533,897 | 8/1985 | Olson et al. | 337/408 |
| 5,691,073 | 11/1997 | Vu et al. | 429/7 |

OTHER PUBLICATIONS

U.S. Provisional Application No. 60/015,153 filed Apr. 10, 1996.

*Primary Examiner*—Gerald P. Tolin
*Assistant Examiner*—Jayprakash N. Gandhi
*Attorney, Agent, or Firm*—Jones, Day, Reavis & Pogue

[57] ABSTRACT

A thermal pellet holds contact-carrying resilient switch blades in bending stress with the contacts closed. Melting of the thermal pellet relieves the bending stress and allows movement of the switch blades to open the contacts.

35 Claims, 1 Drawing Sheet

THERMAL PELLET CUTOFF SWITCH

BACKGROUND OF THE INVENTION

This application relates to the art of thermal cutoffs and, more particularly, to thermal cutoffs that interrupt an electric circuit in response to an elevated temperature. The invention is particularly applicable for use with thermal cutoffs of the type having a dielectric thermal pellet that melts at an elevated temperature to open a circuit and will be described with specific reference thereto. However, it will be appreciated that the invention has broader aspects, and that certain features of the invention can be used in other types of thermal cutoffs and for other purposes.

Thermal cutoffs frequently have one spring for biasing a pair of contacts to a closed position below a predetermined temperature and another spring for biasing the pair of contacts to an open position in response to melting of a thermal pellet above the predetermined temperature. The use of separate springs requires precision in manufacture and assembly of the thermal cutoff, and the extra individual parts complicate the assembly. It would be desirable to have a thermal cutoff that has fewer parts and does not require supplemental springs for biasing contacts to either open or closed positions.

SUMMARY OF THE INVENTION

A pair of resilient contact carrying switch blades are held in bending stress by a thermal pellet to close the contacts. Melting of the thermal pellet allows the bending stress in the switch blades to relax and open the contacts.

In a preferred arrangement, the switch blades and contacts are shaped to provide relative lateral movement between the closed contacts with slight changes in the height of the thermal pellet. Slight relative movement between the closed contacts minimizes the possibility of cold welding of the contacts while they remain closed over an extended period of time.

The thermal cutoff uses a pair of identical switch blade units that are inverted and reversely positioned relative to one another.

It is a principal object of the present invention to provide an improved thermal cutoff that requires no supplemental springs.

It is also an object of the invention to provide a thermal cutoff that minimizes the possibility of cold welding of the contacts.

It is an additional object of the invention to provide a thermal cutoff that is relatively simple and economical to manufacture and assemble.

DESCRIPTION OF A PREFERRED EMBODIMENT

Figure 1:
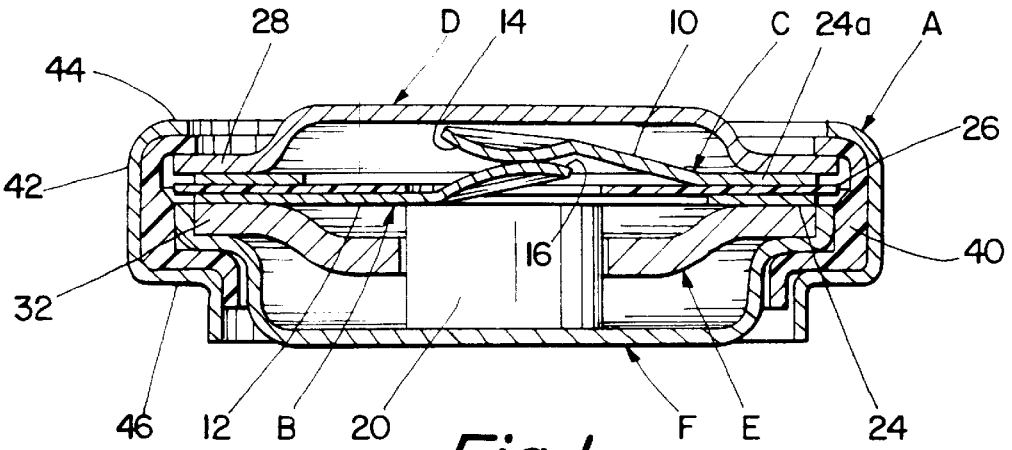
FIG. 1 is a cross-sectional elevational view of a thermal cutoff constructed in accordance with the present application and with the contacts closed.

Referring now to the drawing, wherein the showings are for purposes of illustrating a preferred embodiment of the invention only and not for purposes of limiting same, FIG. 1 shows a pair of resilient switch blades 10,12 carrying contacts 14,16. A cylindrical dielectric thermal pellet 20 having substantially flat and parallel opposite ends holds both of switch blades 10,12 in bending stress with contacts 14,16 closed. When thermal pellet 20 melts, the bending stress in switch blades 10,12 is relieved and the blades move to the position shown in FIG. 2 with contacts 14,16 open.

Figure 3:
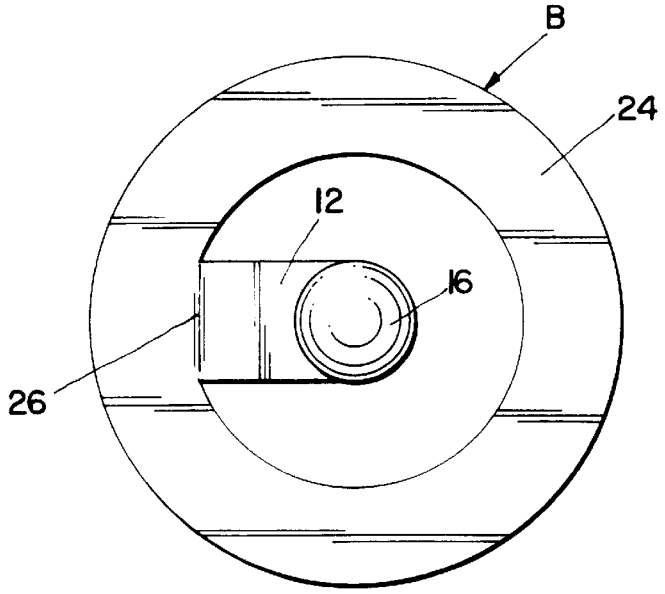
FIG. 3 is a plan view of a switch blade unit used in the thermal cutoff of the FIGS. 1 and 2.

FIG. 3 shows a switch blade unit B having a base portion 24 in the form of a flat annular ring that need not be a complete 360° ring and can be generally U-shaped with an interruption generally opposite from the connection of blade 12 to the base. Switch blade 12 is integral with base portion 24 and is bent along a line generally indicated at 26 to extend out of the plane of flat base portion 24. The free end portion of resilient switch blade 12 is formed into a generally spherical contact 16. Switch blade unit C that carries resilient switch blade 10 has the same shape as described with respect to switch blade unit B. Thus, switch blade units B,C are substantially identical, and are simply inverted and reversely positioned with respect to one another within thermal cutoff A.

Figure 2:
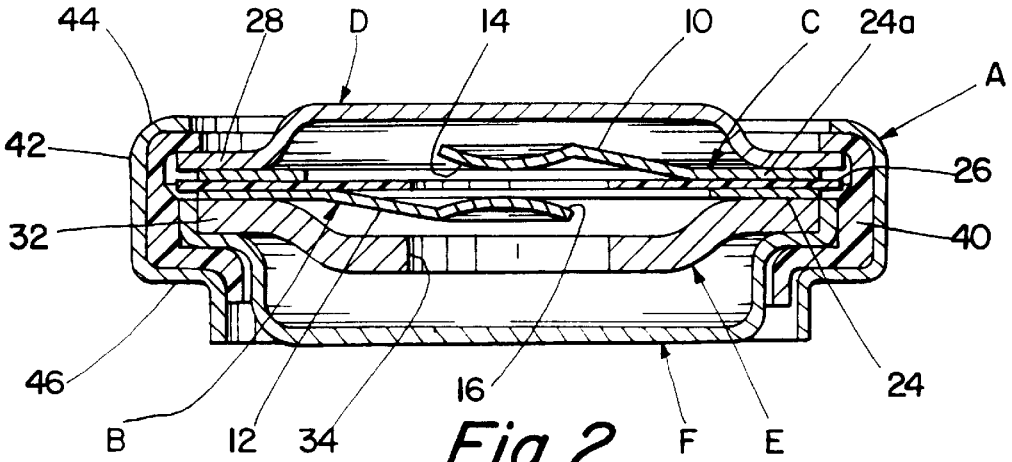
FIG. 2 is a view similar to FIG. 1 with the contacts open.

As shown in FIG. 2, switch blade units B,C are inverted and reversely positioned relative to one another with their switch blades 10,12 extending away from one another as shown in FIG. 2. Switch blade units B,C are rotated 180 degrees relative to one another so that switch blades 10,12 extend toward one another from opposite sides of the central annular openings within the flat base portions of the switch blade units. Bend line 26 for switch blade 12 is positioned opposite the corresponding bend line for switch blade 10.

A dielectric flat washer 26 is positioned between base portions 24,24*a* of switch blade units B,C. A dished disc that forms a cover member D has its peripheral portion 28 positioned in engagement with base portion 24a of switch blade unit C. A pellet guide member and stiffening disc E has its peripheral portion 32 positioned in engagement with flat base portion 24 of switch blade unit B. Disc E has a central circular hole 34 therethrough closely receiving a dielectric thermal pellet 20 of organic material that melts at a predetermined temperature. Thermal pellet 20 rests on a dished bottom disc F that has its peripheral portion engaging the peripheral portion of disc E. Disc E closely surrounds thermal pellet 20 to provide stabilization intermediate the opposite substantially flat ends of the pellet.

A dielectric plastic ring 40 has an inwardly opening annular recess receiving the peripheral portions of cover and bottom discs D,F. All of the discs are clamped tightly together by a metal clamping ring 42 that is crimped around plastic ring 40, and also crimped over inwardly as generally indicated at 44,46 to place the peripheral portions of all the discs, the washer and the switch blade unit in compression.

Thermal pellet 20 rests on bottom disc F and has a predetermined height for bending resilient switch blade 12 to a position in which it is substantially flush with its flat base portion 24. Contact 16 is then in engagement with contact 14 and switch blade 10 is also bent upwardly as shown in FIG. 1 so that both of switch blades 10,12 are in bending stress. The outwardly convex surfaces on contacts 14,16 are such that any slight movement of switch blades 10,12 from the position shown in FIG. 1 will cause relative lateral movement between the contact surfaces that engage one another. Over an extended period of time, when the switch blades move toward pellet 20, their contacts move away from the point of attachment of the blades to their base portions 24,24*a*. Over an extended period of time, the height of thermal pellet 20 will vary slightly with variations in temperature and humidity, and as a result of compression applied thereto by the bending stress in the switch blades. Slight changes in the height of the thermal pellet 20 will provide small movement of the switch blades and corresponding relative lateral movement between the convex surfaces on contacts 14,16 so that the possibility of cold welding of the contacts is minimized while they are held closed over an extended period of time.

The thermal cutoff of the present application has at least one contact-carrying resilient switch blade. Thermal pellet 20 provides the sole force for placing and holding the switch blade in a contacts-closed position under bending stress. Relief of the bending stress in the switch blade upon melting of the thermal pellet provides the sole force for moving the switch blade to a contacts-open position.

Many different organic compounds are used in thermal pellets for thermal cutoffs, and typical examples include caffeine and animal protein. A variety of organic compounds may be used to form the thermal pellet used in the present application depending upon the environment in which the thermal cutoff will be used and on its desired operating characteristics.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

We claim:

1. A thermal cutoff having first and second resilient switch blades positioned in opposed relationship and carrying first and second contacts, said switch blades having an unstressed condition in which said contacts are separated, said switch blades having a stressed condition in which both of said switch blades are in bending stress and said contacts are in engagement with one another, a dielectric thermal pellet engaging one of said first and second resilient switch blades and holding said switch blades in said stressed condition, said thermal pellet being meltable for permitting said switch blades to return to said unstressed condition by relaxation of the bending stress therein, both of said switchblades being movable in a direction away from said thermal pellet to said stressed condition and being movable in a direction toward said thermal pellet to return to said unstressed condition and separate said contacts, and said one switchblade that is engaged by said thermal pellet being movable a greater distance in a direction toward said thermal pellet than the other of said switch blades when said switch blades return to said unstressed condition and said contacts separate upon melting of said thermal pellet.

2. The thermal cutoff of claim 1 wherein said contacts have convexly curved surfaces facing one another and movement of said switch blades from said stressed condition in a direction toward said unstressed condition changes the point of engagement between said contacts.

3. The thermal cutoff of claim 2 wherein said contact surfaces are substantially spherical.

4. The thermal cutoff of claim 1 wherein said switch blades and said thermal pellet are sealed between top and bottom discs.

5. The thermal cutoff of claim 1 wherein each of said switch blades is part of a switch blade unit that includes an integral annular flat base with an inner periphery having a said switch blade extending therefrom out of the plane of said flat base, said switch blade units being inverted and reversely positioned with said switch blades extending away from one another.

6. The thermal cutoff of claim 5 wherein each said switch blade has a bend adjacent the intersection thereof with said inner periphery of said annular flat base, and said switch blade units being positioned with said bends substantially opposite one another.

7. The thermal cutoff of claim 6 wherein said annular flat bases of said switch units are clamped together with a dielectric insulator interposed therebetween.

8. A thermal cutoff comprising top and bottom dished discs enclosing a pair of switch blade units having contact carrying switch blades that extend away from one another with said contacts separated when said switch blades are in a relaxed unstressed condition, a thermal pellet engaging one of said switch blades and bending same toward the other of said switch blades to a stressed position in which said contacts are in engagement and both of said switch blades are in bending stress, melting of said thermal pellet providing separation of said contacts by allowing said switch blades to return to their unstressed condition by movement of both of said switch blades in one direction toward said thermal pellet and with said one switch blade that is engaged by said thermal pellet moving a greater distance in said one direction than the other of said switch blades.

9. The thermal cutoff of claim 8 wherein each of said switch blade units has an annular flat base and each of said switch blades in said relaxed unstressed condition thereof extends out of the plane of said annular flat base, and said one of said switch blades that is engaged by said thermal pellet lying substantially in the same plane as its associated said annular flat base in said stressed position thereof.

10. The thermal cutoff of claim 8 wherein said top and bottom dished discs are held together by a clamping ring and a dielectric ring is interposed between said clamping ring and said dished discs.

11. The thermal cutoff of claim 8 including a stiffening disc within said bottom dished disc, said stiffening disc having a hole therethrough receiving said thermal pellet.

12. The thermal cutoff of claim 8 wherein said thermal pellet is substantially cylindrical and has opposite substantially flat ends, one of said flat ends engaging said one of said switch blades and the other of said flat ends engaging said bottom dished disc.

13. A thermal cutoff having a pair of contact carrying resilient switch blades, a thermal pellet engaging one of said switch blades and placing both of said switch blades in bending stress with said contacts closed, said thermal pellet having a predetermined height and being in compression by virtue of the bending stress in said switch blades, both of said switch blades being movable in one direction toward said thermal pellet to provide separation of said contacts upon melting of said thermal pellet, and said contacts being shaped for providing relative lateral sliding movement therebetween in a direction transversely of said one direction during slight movement of said switch blades in a direction toward said thermal pellet due to changes in said predetermined height of said thermal pellet while it remains solid and unmelted and said contacts remain closed.

14. The thermal cutoff of claim 13 wherein said switch blades are on switch blade units that have annular flat bases, said switch blades being integral with said bases and being permanently bent to extend out of the plane of said bases.

15. The thermal cutoff of claim 13 wherein said thermal pellet has opposite ends and further including a thermal pellet stabilizer surrounding said thermal pellet intermediate said opposite ends thereof.

16. The thermal cutoff of claim 13 wherein said switch blades and said thermal pellet are sealed between top and bottom dished discs.

17. The thermal cutoff of claim 16 and further including a stiffening disc clamped between said top and bottom dished discs and extending intermediate said bottom dished disc and said switch blades.

18. The thermal cutoff of claim 17 wherein said stiffening disc has a central hole through which said thermal pellet extends.

19. A thermal cutoff having first and second resilient switch blades carrying first and second contacts, said switch blades having an unstressed condition in which said contacts are separated, said switch blades having a stressed condition in which both of said switch blades are in bending stress and said contacts are in engagement, a dielectric thermal pellet engaging one of said first and second resilient switch blades and holding said switch blades in said stressed condition, said thermal pellet being meltable for permitting said switch blades to return to said unstressed condition by relaxation of the bending stress therein, and said contacts having convexly curved surfaces facing one another so that movement of said switch blades from said stressed condition in a direction toward said unstressed condition changes the point of engagement between said contacts.

20. The thermal cutoff of claim 19 wherein said contact surfaces are substantially spherical.

21. A thermal cutoff having first and second resilient switch blades carrying first and second contacts, said switch blades having an unstressed condition in which said contacts are separated, said switch blades having a stressed condition in which both of said switch blades are in bending stress and said contacts are in engagement, a dielectric thermal pellet engaging one of said first and second resilient switch blades and holding said switch blades in said stressed condition, said thermal pellet being meltable for permitting said switch blades to return to said unstressed condition by relaxation of the bending stress therein, and said switch blades and said thermal pellet being sealed between top and bottom discs.

22. A thermal cutoff having first and second resilient switch blades carrying first and second contacts, said switch blades having an unstressed condition in which said contacts are separated, said switch blades having a stressed condition in which both of said switch blades are in bending stress and said contacts are in engagement, a dielectric thermal pellet engaging one of said first and second resilient switch blades and holding said switch blades in said stressed condition, said thermal pellet being meltable for permitting said switch blades to return to said unstressed condition by relaxation of the bending stress therein, and each of said switch blades being part of a switch blade unit that includes an integral annular flat base with an inner periphery having a said switch blade extending therefrom out of the plane of said flat base, said switch blade units being inverted and reversely positioned with said switch blades extending away from one another.

23. The thermal cutoff of claim 22 wherein each said switch blade has a bend adjacent the intersection thereof with said inner periphery of said annular flat base, and said switch blade units being positioned with said bends substantially opposite one another.

24. The thermal cutoff of claim 23 wherein said annular flat bases of said switch units are clamped together with a dielectric insulator interposed therebetween.

25. A thermal cutoff comprising top and bottom dished discs enclosing a pair of switch blade units having contact carrying switch blades that extend away from one another with said contacts separated when said switch blades are in a relaxed unstressed condition, a thermal pellet engaging one of said switch blades and bending same toward the other of said switch blades to a stressed position in which said contacts are in engagement and both of said switch blades are in bending stress, each of said switch blade units having an annular flat base and each of said switch blades in said relaxed unstressed condition thereof extending out of the plane of said annular flat base, and said one of said switch blades that is engaged by said thermal pellet lying substantially in the same plane as its associated said annular flat base in said stressed position thereof.

26. A thermal cutoff comprising top and bottom dished discs enclosing a pair of switch blade units having contact carrying switch blades that extend away from one another with said contacts separated when said switch blades are in a relaxed unstressed condition, a thermal pellet engaging one of said switch blades and bending same toward the other of said switch blades to a stressed position in which said contacts are in engagement and both of said switch blades are in bending stress, said top and bottom dished discs being held together by a clamping ring, and a dielectric ring interposed between said clamping ring and said dished discs.

27. A thermal cutoff comprising top and bottom dished discs enclosing a pair of switch blade units having contact carrying switch blades that extend away from one another with said contacts separated when said switch blades are in a relaxed unstressed condition, a thermal pellet engaging one of said switch blades and bending same toward the other of said switch blades to a stressed position in which said contacts are in engagement and both of said switch blades are in bending stress, a stiffening disc within said bottom dished disc, said stiffening disc having a hole therethrough receiving said thermal pellet.

28. A thermal cutoff comprising top and bottom dished discs enclosing a pair of switch blade units having contact carrying switch blades that extend away from one another with said contacts separated when said switch blades are in a relaxed unstressed condition, a thermal pellet engaging one of said switch blades and bending same toward the other of said switch blades to a stressed position in which said contacts are in engagement and both of said switch blades are in bending stress, said thermal pellet being substantially cylindrical and having opposite substantially flat ends, and one of said flat ends engaging said one of said switch blades and the other of said flat ends engaging said bottom dished disc.

29. A thermal cutoff having a pair of contact carrying resilient switch blades, a thermal pellet engaging one of said switch blades and placing both of said switch blades in bending stress with said contacts closed, said thermal pellet having a predetermined height and being in compression by virtue of the bending stress in said switch blades, said contacts being shaped for providing relative lateral sliding movement therebetween during movement of said switch blades due to changes in said predetermined height of said thermal pellet, said switch blades being on switch blade units that have annular flat bases, and said switch blades being integral with said bases and being permanently bent to extend out of the plane of said bases.

30. A thermal cutoff having a pair of contact carrying resilient switch blades, a thermal pellet engaging one of said switch blades and placing both of said switch blades in bending stress with said contacts closed, said thermal pellet having a predetermined height and being in compression by virtue of the bending stress in said switch blades, said contacts being shaped for providing relative lateral sliding movement therebetween during movement of said switch blades due to changes in said predetermined height of said thermal pellet, said thermal pellet having opposite ends, and a thermal pellet stabilizer surrounding said thermal pellet intermediate said opposite ends thereof.

31. A thermal cutoff having a pair of contact carrying resilient switch blades, a thermal pellet engaging one of said switch blades and placing both of said switch blades in bending stress with said contacts closed, said thermal pellet having a predetermined height and being in compression by virtue of the bending stress in said switch blades, said contacts being shaped for providing relative lateral sliding movement therebetween during movement of said switch blades due to changes in said predetermined height of said thermal pellet, and said switch blades and said thermal pellet being sealed between top and bottom dished discs.

32. The thermal cutoff of claim 31 and further including a stiffening disc clamped between said top and bottom dished discs and extending intermediate said bottom dished disc and said switch blades.

33. The thermal cutoff of claim 32 wherein said stiffening disc has a central hole through which said thermal pellet extends.

34. A thermal cutoff having a pair of electrical contacts and at least one resilient switch blade carrying one of said contacts, a thermal pellet engaging said one resilient switch blade and placing same in bending stress in a contacts-closed position, said contacts being openable upon melting of said thermal pellet by relief of bending stress in said one resilient switch blade, said thermal pellet providing the sole force for placing said one resilient switch blade in said contacts-closed position, relief of bending stress in said one resilient switch blade upon melting of said thermal pellet providing the sole force for opening said contacts, said thermal pellet having opposite ends, and a thermal pellet stabilizer surrounding said thermal pellet intermediate said opposite ends thereof.

35. A thermal cutoff having a pair of electrical contacts and at least one resilient switch blade carrying one of said contacts, a thermal pellet engaging said one resilient switch blade and placing same in bending stress in a contacts-closed position, said contacts being openable upon melting of said thermal pellet by relief of bending stress in said one resilient switch blade, said thermal pellet providing the sole force for placing said one resilient switch blade in said contacts-closed position, relief of bending stress in said one resilient switch blade upon melting of said thermal pellet providing the sole force for opening said contacts, top and bottom dished discs enclosing said switch blade and said thermal pellet, a stiffening disc clamped between said top and bottom dished discs and extending intermediate said bottom dished disc and said switch blade, and said stiffening disc having a hole through which said thermal pellet extends.

* * * * *